US005236039A

United States Patent [19]

Edelstein et al.

[11] Patent Number: 5,236,039

[45] Date of Patent: Aug. 17, 1993

[54] BALANCED-LINE RF ELECTRODE SYSTEM FOR USE IN RF GROUND HEATING TO RECOVER OIL FROM OIL SHALE

[75] Inventors: William A. Edelstein, Schenectady, N.Y.; Harold J. Vinegar; Chia-Fu Hsu, both of Houston, Tex.; Otward M. Mueller, Ballston Lake, N.Y.

[73] Assignee: General Electric Company, Schenectady, N.Y.

[21] Appl. No.: 899,839

[22] Filed: Jun. 17, 1992

[51] Int. Cl.[5] ..... E21B 43/24; E21B 43/30

[52] U.S. Cl. ..... 166/248; 166/60; 166/65.1; 166/272

[58] Field of Search ..... 166/50, 65.1, 248, 302

[56] References Cited

U.S. PATENT DOCUMENTS

| | | | |
|---|---|---|---|
| Re. 30,738 | 9/1981 | Bridges et al. | 166/248 |
| 33,259 | 7/1990 | Crooks et al. | 324/309 |
| 4,140,179 | 2/1979 | Kasevich et al. | 166/248 |
| 4,140,180 | 2/1979 | Bridges et al. | 166/248 |
| 4,144,935 | 3/1979 | Bridges et al. | 166/248 |
| 4,470,459 | 9/1984 | Copland | 166/50 X |
| 4,576,231 | 3/1986 | Dowling et al. | 166/248 |
| 4,886,118 | 12/1989 | Van Meurs et al. | 166/245 |

OTHER PUBLICATIONS

In Situ reporting of Oil Shale Using RF Heating by J. R. Bowden, G. D. Gould, R. R. McKinsey, J. E. Bridges and G. C. Sresty, presented at Synfuels 5th Worldwide Symposium, Washington, D.C., 1985.

Petroleum Formation and Occurrence: A New Approach to Oil and Gas Exploration, B. P. Tissot and D. H. Welte, Springer-Verlag, 1978, p. 235.

Radio Engineers' Handbook by Frederick E. Terman, McGraw-Hill, 1943, p. 773.

*Primary Examiner*—Ramon S. Britts
*Assistant Examiner*—Frank S. Tsay
*Attorney, Agent, or Firm*—Lawrence P. Zale; Marvin Snyder

[57] ABSTRACT

An in-situ method of extracting oil from a hydrocarbon bearing layer such as oil-shale or tar sands lying beneath a surface layer comprises applying a radiofrequency excitation signal to the hydrocarbon bearing layer through a system of electrodes. The electrodes are inserted into a matrix of holes drilled through the surface layer and into the hydrocarbon bearing layer. A coaxial line extending through the surface layer is connected to the electrodes extending into the hydrocarbon bearing layer. The electrodes have a length that is an integral number of quarter wavelengths of the radiofrequency energy. A matching network connected between the coaxial cable and a respective one of the electrodes maximizes the power flow into each electrode. The electrodes are excited uniformly in rows and as a "balanced-line" RF array where adjacent rows of electrodes are 180° out of phase. This method does not produce substantial heating of the surface layer or the region surrounding the producing layer, and concentrates most of its power in the hydrocarbon bearing layer.

7 Claims, 5 Drawing Sheets

BALANCED-LINE RF ELECTRODE SYSTEM FOR USE IN RF GROUND HEATING TO RECOVER OIL FROM OIL SHALE

BACKGROUND OF THE INVENTION

1. Field of the Invention

This invention relates to recovery of oil from a hydrocarbon bearing layer and more specifically to use of radiofrequency ground heating to extract oil from a hydrocarbon bearing layerin-situ.

2. Description of Related Art

Oil shale, contains no oil and little extractable bitumen, but does contain organic matter composed mainly of an insoluble solid material called kerogen. Shale oil can be generated from kerogen during pyrolysis, a treatment that consists of heating the oil shale to elevated temperatures (typically, greater than 350° C.). The amount of worldwide potential oil reserves from kerogen in oil shale is estimated to be about 4.4 trillion barrels according to B. P. Tissot and D. H. Welte in *Petroleum Formation and Occurrence: A New Approach to Oil and Gas Exploration*, Springer-Verlag, New York, 1978, p. 235. Of this, approximately ⅔, or 2.9 trillion barrels, are contained in the United States in the Green River Shales of Colorado, Utah and Wyoming. The next largest oil shale reserves are the Irati Shales of Brazil, with about 1.1 trillion barrels, while other large quantities of oil shale are found in Australia, Canada, China, Estonia, France, Great Britain, Spain, Sweden, Switzerland, Uruguay, Yugoslavia and Zaire.

Because of the large supply in the United States, a practical method of extracting this oil at competitive prices (less than 20 per barrel) could substantially change the energy balance between the United States and the rest of the world.

Below an oil yield of 6 gallons/ton, more energy is expended in heating the oil shale to pyrolysis than the calorific value of the kerogen contained within it. This is defined as the lower production limit for commercial oil shales. The average oil shale richness in the Green River Shales is about 20 gallons/ton.

Bridges and Taflove of the Illinois Institute of Technology Research Institute (IITRI) proposed mining a shaft through material above oil shale, known as overburden, to the top of the oil shale and inserting an array of electrodes into the oil shale starting from this shaft. This method for RF heating of oil shale is described in U.S. Pat. No. 4,144,935, *Apparatus and Method For Insitu Heat Processing of Hydrocarbonaceous Formations* by J. Bridges and A. Taflove issued Mar. 20, 1979. Their electrode array is designed to be a "triplate," where the center electrode row is at high potential and the adjacent rows on either side at ground potential. The IITRI process is extremely expensive in the United States because the Green River shale typically has an overburden of 600–800 feet. Any underground mining operation to install an electrode array at this depth is uneconomic at today's oil prices.

A somewhat different method of RF shale heating utilizes an array of specially designed dipole antennas inserted into the ground, described in U.S. Pat. No. 4,140,179, *In-situ Radio Frequency Selective Heating Process* by R. S. Kasevich, M. Kolker and A. S. Dwyer issued Feb. 20, 1979. A problem with this approach is that the antenna elements must be matched to the electrical conditions of the surrounding formation. As the formation is heated, the electrical conditions can change, and the dipole antenna elements have to be removed and changed, which presents significant practical and economic difficulties.

Other prior art methods of extracting oil from oil shale involve the use of linear resistive heating elements embedded in the oil shale. These linear resistive heating elements apply heat to the oil shale immediately adjacent the elements. The heat distribution to the remainder of the oil shale is controlled by the rather slow thermal diffusivity of the oil shale. One such method is disclosed in U.S. Pat. No. 4,886,118 *Conductively Heating a Subterranean Oil Shale to Create Permeability and Subsequently Produce Oil* by Peter Van Meurs, Eric de Rouffignac, Harold Vinegar and Michael Lucid issued Dec. 12, 1989 ("7-spot thermal conductivity patent"). This invention employs a seven-spot pattern to apply heat to the oil shale through thermal conduction. Each repeating pattern has six resistive heating wells surrounding an oil production well. The resistive heating elements heat oil shale bounded by the heating wells to pyrolysis. Oil is collected by the production wells and is pumped to the surface. The main disadvantage of thermal conduction heating is that thermal conduction sources have to be very close together. For example, this invention employs 50-foot spacing between the heating elements. Because of the low heat conductivities of oil shale, the maximum heat injection rate per well for thermal conduction wells is about 200 watts/-foot, so that thermal conduction heating requires on the order of 15–20 injectors per acre. This density of heating wells can be very expensive and renders the process not economically feasible at today's oil prices.

At present, there is a need for a method of extracting oil from a hydrocarbon bearing layer, such as oil shale, that is economical and efficient.

SUMMARY OF THE INVENTION

A system for extracting oil in-situ from a hydrocarbon bearing layer below a surface layer employs a master oscillator for producing a fundamental frequency, a plurality of radiofrequency (RF) heating sources, and a matching network. The heating sources have conductive electrodes situated in a rectangular pattern in a hydrocarbon bearing layer beneath the surface. Production wells are provided at the center of each rectangular pattern for collecting the oil and producing it at the surface. An RF amplifier provides a radiofrequency excitation signal that is transmitted through a shielded coaxial line to the electrode located in the hydrocarbon bearing layer. The shielded coaxial line passes through the surface layer and transmits the RF excitation signal to the electrode without substantial power loss. A matching network is coupled between each electrode and each coaxial line for maximizing the energy transfer from the coaxial line to each electrode. The currents among the electrode array uniformly heat the oil-rich layer in-situ to pyrolysis. The electrode array is excited in a "balanced-line" configuration where adjacent rows of electrodes are 180° out of phase. Oil reaches the production wells by fracturing the hydrocarbon bearing layer and creating permeable paths to the production wells.

OBJECTS OF THE INVENTION

It is an object of the present invention to provide a method of extracting oil from a hydrocarbon bearing layer such as oil shale and tar sands which is more efficient than commercial methods.

It is another object of the present invention to provide a method of extracting oil from a hydrocarbon bearing layer with RF energy which requires a lower, and hence safer, voltage than conventional methods.

It is another object of the invention to provide a method of extracting oil from a hydrocarbon bearing layer beneath the surface with a minimum of excavation and at a higher rate than conventional methods.

It is another object of the invention to provide a ground heating method of collecting oil from a hydrocarbon bearing layer which minimizes thermal cracking of the oil.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawing in which:

DETAILED DESCRIPTION OF THE INVENTION

In radiofrequency (RF) heating, RF thermal energy can be generated in a reservoir, away from a heat source, or injector well, in a manner not limited by the heat conductivity of the formation. In this regard, radiofrequency heating can be viewed as a superset of thermal conduction heating, because heat is transported away from the injector well both by RF heating and also by thermal conduction. For example, four times the power can be applied to an RF injecter well as compared with a thermal conduction well, thereby requiring, for example, either ¼ the number of wells, or ½ the number of wells and ½ the process time for an equivalent amount of oil produced as compared to a thermal conduction heating well.

In radiofrequency heating, the electric field $\vec{E}$ is governed by the Maxwell equations which can be expressed in terms of the magnetic vector potential $\vec{A}$:

$$\nabla^2 A - \gamma^2 A = 0 \quad [1]$$

and $$\gamma^2 = -\omega\mu\epsilon + j\omega\mu\sigma \quad [2]$$

where $j=\sqrt{-1}$, $\omega$ is the angular frequency, $\epsilon$ is the dielectric permittivity, $\sigma$ is the conductivity and $\mu$ is the magnetic permeability, and $\nabla$ is the vector gradient operator. For given current profiles at the electrodes, equation [2] is solved for the scalar potential $\Phi$:

$$\Phi = -\vec{\nabla}\bullet\vec{A}/(\mu\sigma + j\mu\epsilon\omega) \quad [3]$$

and the electric field $\vec{E}$ is given by:

$$\vec{E} = -\vec{\nabla}\Phi - j\omega\vec{A} \quad [4]$$

Temperature in the reservoir can then be determined by:

$$M(\partial T/\partial t) = \vec{\nabla}\cdot(K\vec{\nabla}T) + \sigma|\vec{E}|^2 \quad [5]$$

where M is the volumetric heat capacity of the reservoir, T is the temperature, t is the heating time, and K is the thermal conductivity. We then use first-order kinetics to forecast the kerogen converted oil per unit time known as the kerogen retorting rate of the hydrocarbon bearing layer.

Figure 1:
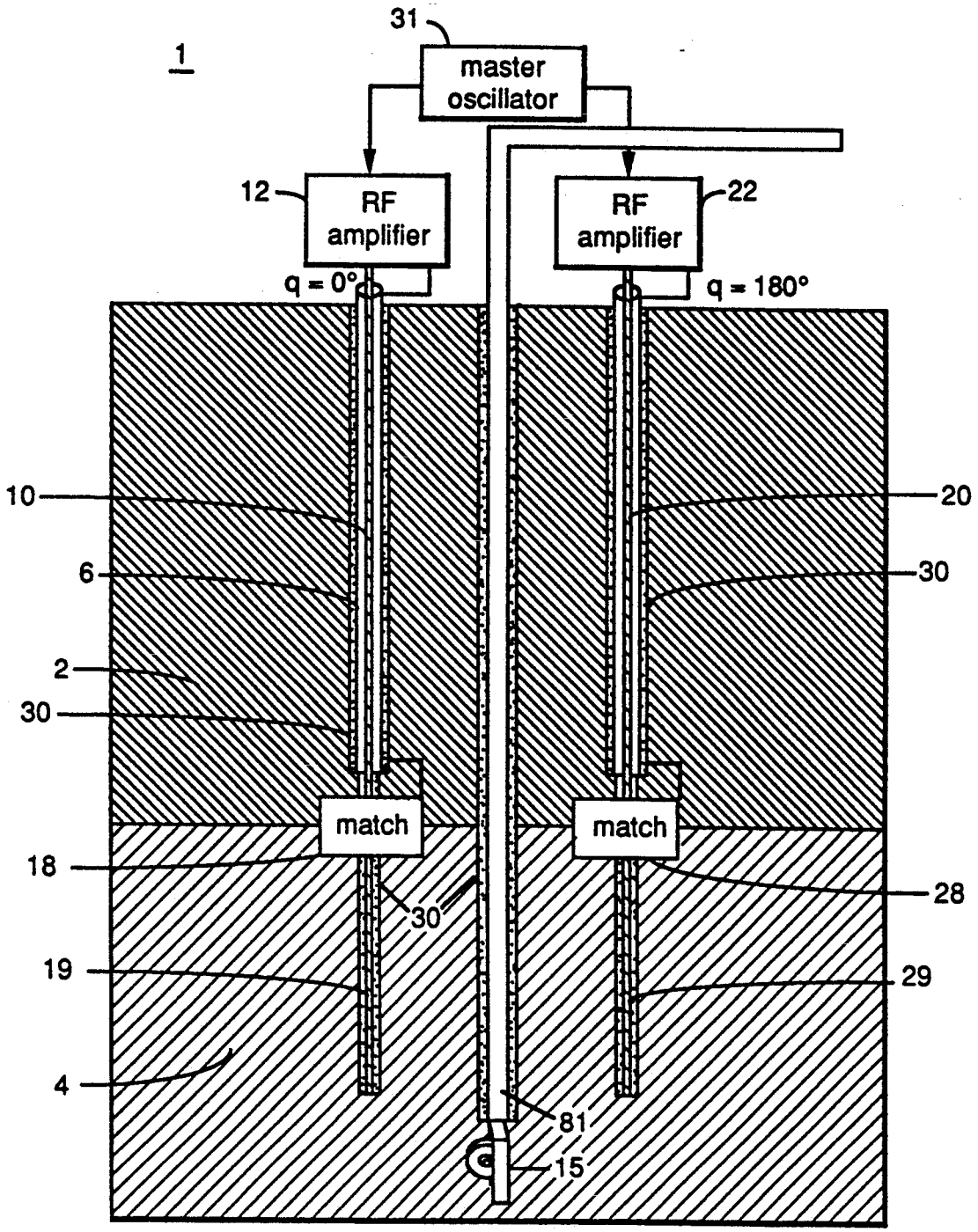
FIG. 1 is a diagram of an oil extraction system according to the present invention as implemented in-situ.

In FIG. 1, a system 1 is shown for using a master oscillator 31 for producing a fundamental frequency $\lambda$. A plurality of radiofrequency (RF) amplifiers 12, 22 (only two are shown here for simplicity) provide a radiofrequency signal based upon the fundamental frequency $\lambda$ which eventually provide heat to a hydrocarbon bearing layer 4, such as oil-shale or tar sands, situated below a thick surface layer 2 (overburden). A matrix of holes 6 are drilled through overburden 2 with a rotary drilling rig and into the hydrocarbon bearing layer 4. A large array of coaxial lines 10, 20 is inserted and fixed in place with cement 30 in holes 6 ending in electrodes 19, 29 respectively. The outer shield of the coaxial line extends through overburden 2 to the boundary between overburden 2 and hydrocarbon bearing layer 4. Conductors 19, 29 (which may be insulated) extending into the oil hydrocarbon bearing layer 4 act as electrodes. A matching network 18, 28 coupled between the cables 10, 20 and electrodes 19, 29 alters the overall conductance and resistance to maximize the power flow into each electrode. The length of electrodes 19, 29 is preferably an odd multiple of a quarter wavelength of the fundamental excitation wavelength such that the impedance viewed from the matching network is real (resistive with phase angle approximately zero). The length d of electrodes 19, 29 is defined by:

$$d = (2n+1)(\lambda/4) \quad [6]$$

The voltages on electrodes 19 and 29 are 180° out of phase as defined by the master oscillator at the ground surface. Therefore electrical currents between electrodes 19 and 29 will apply energy to hydrocarbon bearing layer 4 and thereby heat the hydrocarbon bearing layer. Producer well 81 collects the oil which is formed when kerogen in hydrocarbon bearing layer 4 is pyrolized into shale oil. The production well is somewhat deeper than the electrode wells and is open to the hydrocarbon bearing layer via perforations in the well casing. The production well is equipped with production tubing which conveys the oil to the surface. A pump 15 moves the oil from the hydrocarbon bearing layer to the surface. Hydrocarbon vapors are also collected in producer well 81.

Figure 2:
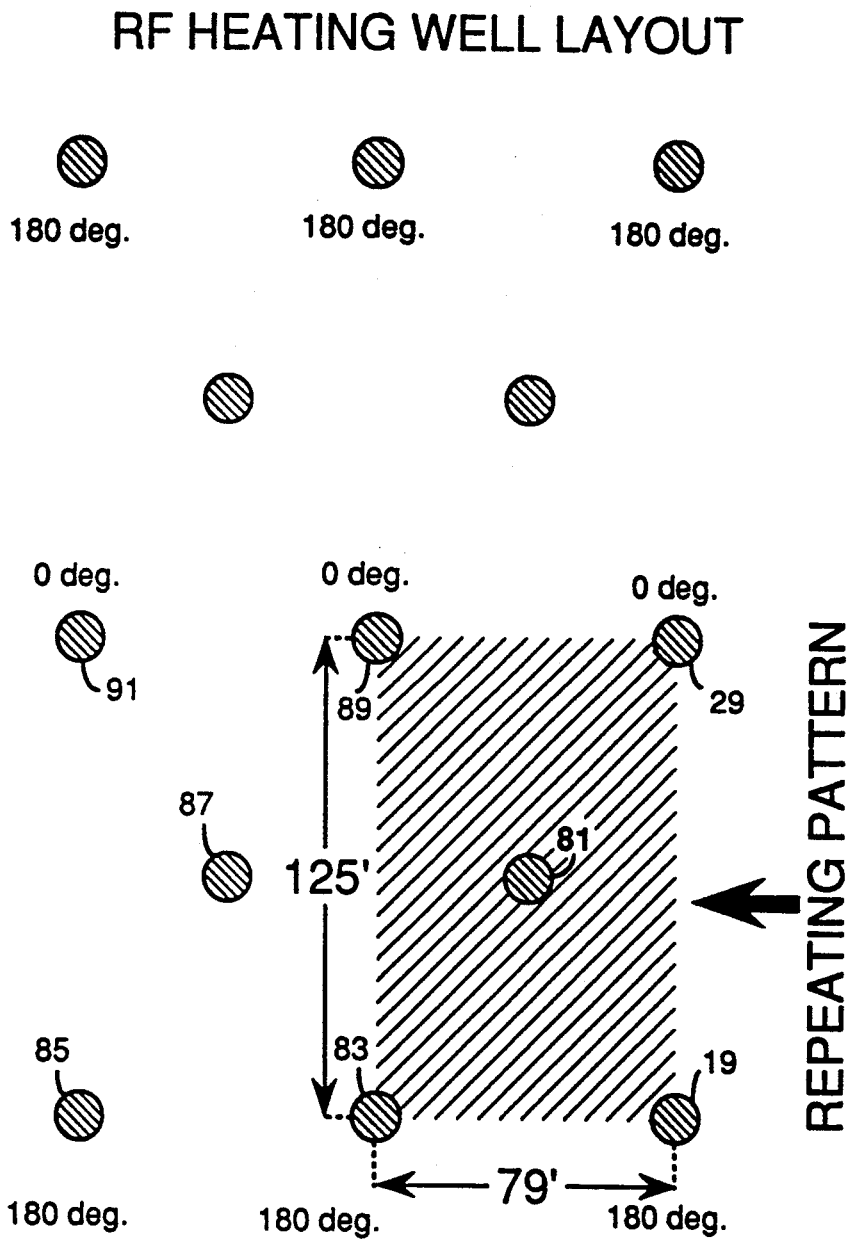
FIG. 2 is a plan view showing the placement of electrodes and producer wells of the present invention as they appear in-situ.

FIG. 2 represents electrodes 19, 29 of FIG. 1 as solid circles and producer wells 81 as open circles, in a top plan view. The electrode rows are positioned substantially closer than a wavelength apart, and the electrodes within each row are positioned substantially closer than the row-to-row spacing. Typical values for distances within a row or between rows are 79 feet between electrodes in a row and 125 feet between rows. All the electrodes within each row are excited in-phase and the excitations in the rows alternate from in-phase to anti-phase to in-phase to anti-phase, etc. For example, electrodes 29, 89 and 91 in the center row receive a 0° excitation signal while electrodes 19, 83 and 85 receive a 180° excitation. We refer to this electrode pattern as a "balanced line" pattern.

With this arrangement, the rows act approximately as sheet sources and the heating of the region between rows is uniform as described in *In Situ Retorting of Oil Shale Using RF Heating*, by J. R. Bowden, G. D. Gould, R. R. McKinsey, J. E. Bridges, and G. C. Sresty, presented at Synfuels 5th Worldwide Symposium, Washington, D.C., 1985.

Figure 3:
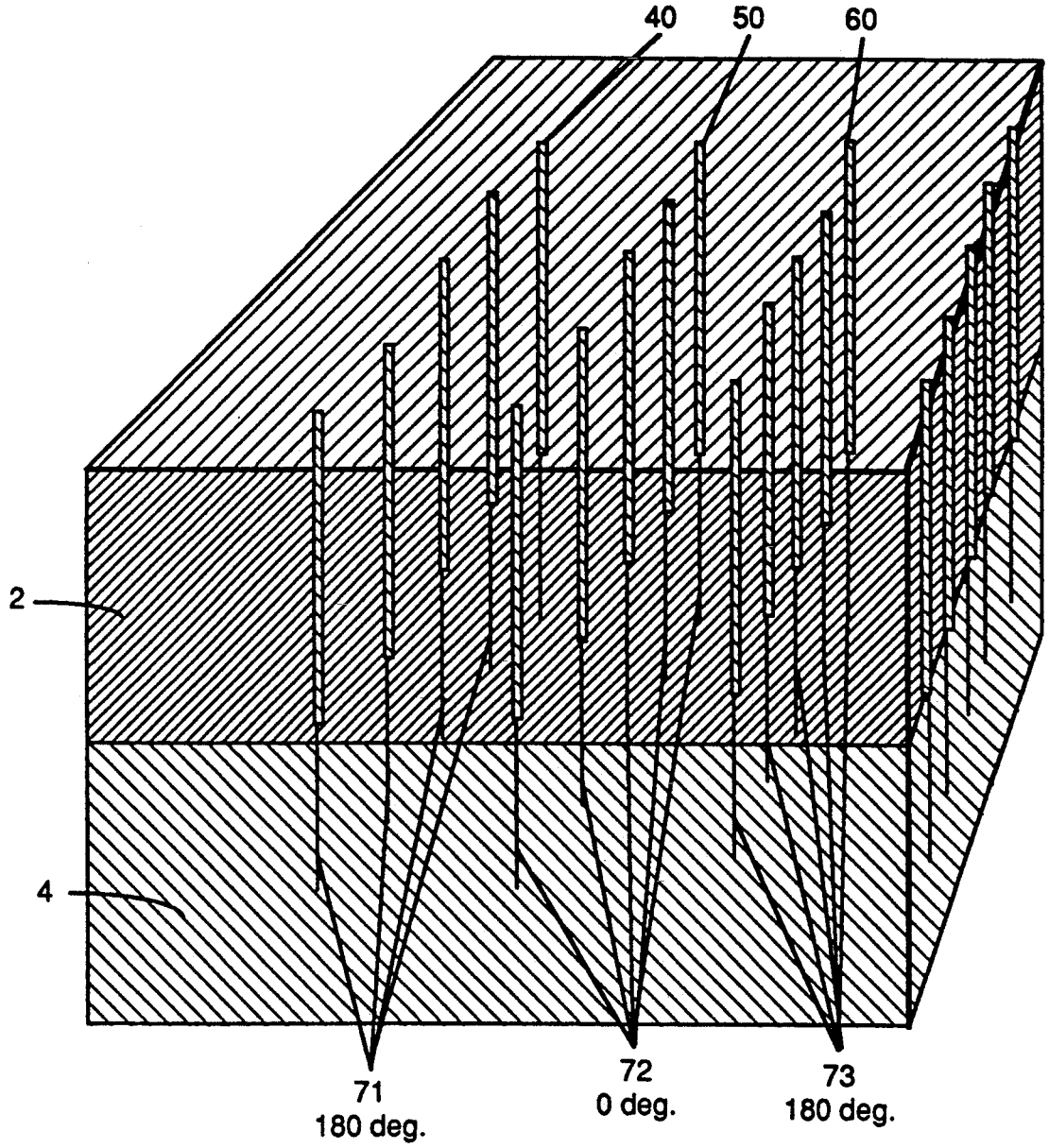
FIG. 3 is a three-dimensional view of only the placement of electrodes of the present invention as they appear in-situ.

FIG. 3 illustrates an electrode arrangement with electrodes 71, 72, 73 arranged in rows 40, 50, and 60 respectively with the remainder of the system omitted for clarity. For example, electrode 72 in row 50 receives a 0° excitation signal while at the same time, electrodes 71 and 73 receive a 180° excitation signal. Each electrode 73 in row 60 receives an excitation signal that is shifted 180° from that of row 50. Similarly each electrode 71 of row 40 receives an excitation signal that is shifted 180° from that of row 50. This results in a matrix of electrodes in each row all having the same sign of excitation, with alternate rows having the opposite sign of excitation. The electrode rows are positioned substantially closer than a wavelength and the electrodes within each row are spaced substantially closer than the row spacing.

Figure 4:
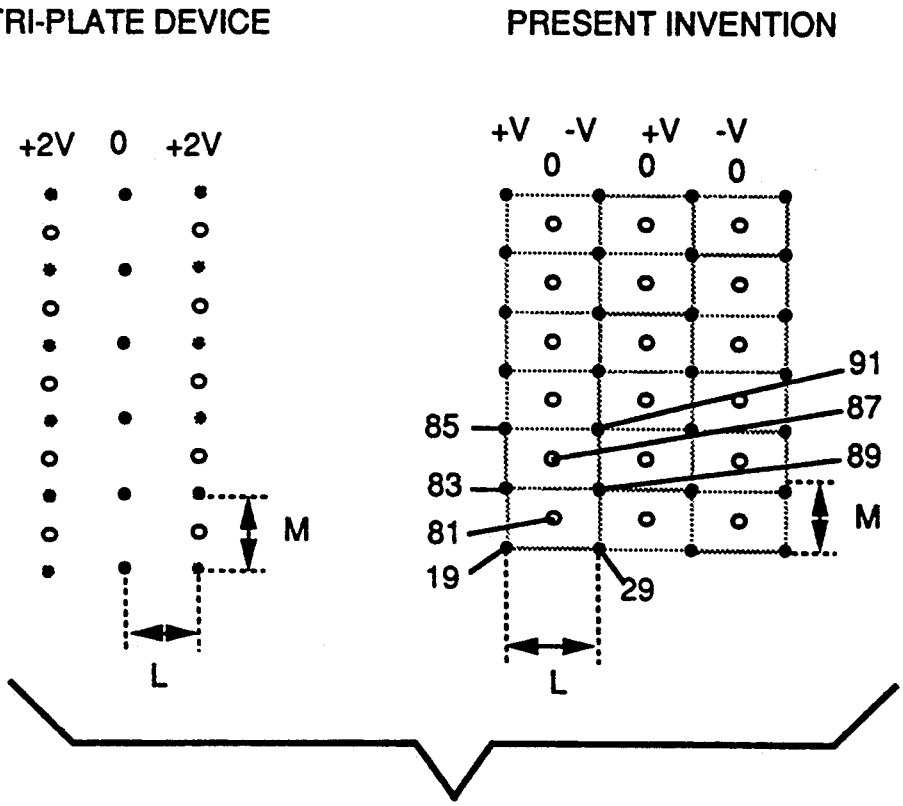
FIG. 4 is an illustration of the electrode placement according to the triplate pattern and a pattern according to the present invention as shown in FIG. 2.

FIG. 4 illustrates a prior art triplate pattern and a balanced-line pattern according to the present invention. A ground is illustrated by a shaded circle, an electrode by a solid circle, and a producer well by an open circle.

As compared with the triplate pattern, the balanced-line RF pattern of this invention allows producer wells 81, 87 to be located midway between electrode rows at the plane of zero potential in the electric field created by electrodes 19, 83 and 85 in one row and 29, 89, and 91 in the adjacent row, and enables the collection pipes 81, 87 to be at a safe electrical potential even if they are of metallic construction. Moreover, this location of the collection pipes 81, 87 is the coolest spot in the pattern, which prevents overheating and thermally wasting the liquid hydrocarbons. By separating the RF electrode wells from collection pipes, the electric field lines do not converge at the collection pipes so that the wells stay cooler.

Typical RF excitation signal frequencies range from 0.1 to 100 MHz, although 1-10 MHz is preferred, depending on the electrical properties of the hydrocarbon bearing layer.

A matching circuit 18, 28 of FIG. 1 maximizes the power transferred from coaxial lines 10, 20 to electrodes 19, 29, respectively. The RF energy is transmitted essentially without loss through the overburden 2, and electric and magnetic fields generated between electrodes 19, 29 are largely confined to hydrocarbon bearing layer 4. Thus, negligible RF interference is generated from overburden 2.

Simulations of the RF heating process have been performed using a finite difference simulator which can calculate the electric and magnetic fields and the currents in the formation, as well as the temperatures and oil production rates.

Figure 5:
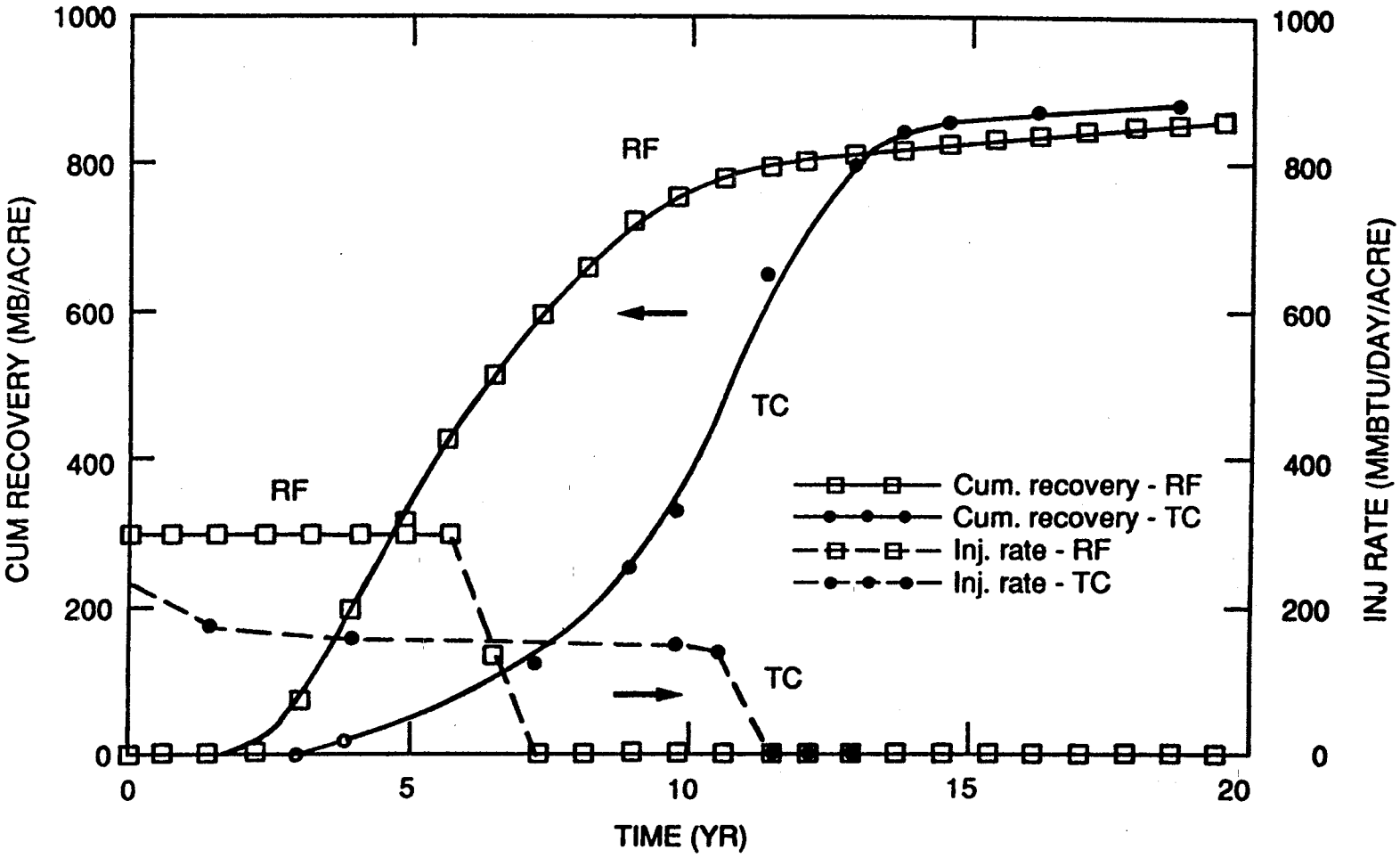
FIG. 5 is a graphical comparison of cumulative oil recovery over time using a thermal conduction apparatus versus using the process according to the present invention.

Simulations for typical Central Basin oil shales in Colorado have been performed using a finite difference simulator to simulate the present invention. FIG. 5 compares the cumulative recovery versus time with the balanced-line RF pattern (RF) of the present invention arranged according to FIG. 2, compared with a 7-spot thermal conduction (TC) patent pattern with 50 feet between wells. The axis on the right side of FIG. 5 indicates the injection rate in millions of BTUs per day per acre. The injection rate for the thermal conduction 7-spot pattern is indicated by the broken line having solid dots and labeled "TC". The injection rate for the balanced-line device according the present invention is indicated by the broken line having open squares and labeled "RF".

For the simulation it is assumed that the repeating pattern is 0.226 acres in area. The original oil in place is 255.2 thousand barrels per pattern. The working portion of the wells, known as the completion interval, extends from 762 feet to 1560 feet for both production wells and electrodes. The total well depth is 1560 feet. 1 MHz radiofrequency power is utilized and standing waves on the electrodes have been suppressed using distributed capacitive loading as is well known in the art (Frederick E. Terman, *Radio Engineers' Handbook*, McGraw-Hill, New York, 1943, pg. 773).

In Table 1, the production of a single pattern of wells according to the present invention are shown over the life of the wells. Also shown is the cumulative power required to produce the oil. The columns in Table 1 for a single pattern, from left to right, are:

processing time in years,
cumulative oil recovery in thousands of barrels,
cumulative oil recovery as a percent of the original oil in place,
cumulative water recovered in thousands of barrels,
cumulative gas recovered in thousands of standard cubic feet,
fluid pressure in pounds per square inch absolute,
fluid temperature in degrees F., and
cumulative electric power consumed in kilowatt-hours.

TABLE 1

OIL SHALE RF HEATING FORECASTS
(Without standing waves and current decay)

| Time (years) | Cum oil (kbbls) | Recovery (% OOIP) | Cum water (kbbls) | Cum gas (Mscf) | Fluid Press. PSIA | Fluid temp. (°F.) | Cum Elec. (kW-hr) |
|---|---|---|---|---|---|---|---|
| 1 | 0.15 | 0.06 | 12.35 | 0.17 | 50 | 112 | 7.20E + 06 |
| 2 | 1.40 | 0.55 | 24.79 | 1.68 | 50 | 151 | 1.44E + 07 |
| 3 | 14.44 | 5.66 | 26.01 | 17.32 | 50 | 204 | 2.16E + 07 |
| 4 | 45.22 | 17.72 | 28.87 | 54.27 | 50 | 267 | 2.88E + 07 |
| 5 | 75.92 | 29.75 | 31.72 | 91.11 | 50 | 336 | 3.60E + 07 |
| 6 | 107.46 | 42.11 | 34.66 | 128.86 | 50 | 409 | 4.21E + 07 |

TABLE 1-continued

OIL SHALE RF HEATING FORECASTS
(Without standing waves and current decay)

| Time (years) | Cum oil (kbbls) | Recovery (% OOIP) | Cum water (kbbls) | Cum gas (Mscf) | Fluid Press. PSIA | Fluid temp. (°F.) | Cum Elec. (kW-hr) |
|---|---|---|---|---|---|---|---|
| 7 | 131.73 | 51.62 | 36.92 | 158.08 | 50 | 466 | 4.32E + 07 |
| 8 | 150.31 | 58.90 | 38.64 | 180.38 | 50 | 506 | 4.32E + 07 |
| 9 | 163.99 | 64.26 | 39.92 | 196.79 | 50 | 533 | 4.32E + 07 |
| 10 | 171.49 | 67.20 | 40.61 | 205.79 | 50 | 550 | 4.32E + 07 |
| 11 | 176.57 | 69.19 | 41.09 | 211.89 | 50 | 561 | 4.32E + 07 |
| 12 | 179.89 | 70.49 | 41.39 | 215.87 | 50 | 568 | 4.32E + 07 |
| 13 | 181.98 | 71.31 | 41.59 | 218.38 | 50 | 571 | 4.32E + 07 |
| 14 | 183.90 | 72.06 | 41.77 | 220.68 | 50 | 573 | 4.32E + 07 |
| 15 | 185.63 | 72.74 | 41.93 | 222.76 | 50 | 575 | 4.32E + 07 |
| 16 | 187.21 | 73.36 | 42.07 | 224.66 | 50 | 575 | 4.32E + 07 |
| 17 | 188.64 | 73.92 | 42.21 | 226.37 | 50 | 575 | 4.32E + 07 |
| 18 | 189.95 | 74.43 | 42.33 | 227.93 | 50 | 575 | 4.32E + 07 |
| 19 | 191.12 | 74.89 | 42.44 | 229.34 | 50 | 574 | 4.32E + 07 |
| 20 | 191.12 | 74.89 | 42.44 | 229.34 | 50 | 574 | 4.32E + 07 |

In the RF process, heat can be injected at twice the rate of the thermal conduction process, as shown in FIG. 5, leading to a speeding up of the halfway point of the process from 12 years to 6 years. The balanced line radiofrequency pattern of the present invention would require roughly half as many wells as would the thermal conduction heating process.

Table 2 compares the triplate pattern with the balanced line RF array of the present invention for one row spacing, and the triplate device and the thermal conduction 7-spot device for another row spacing. The information in the left-hand column of Table 2 is as follows:

L and M are the spacing between rows and columns in feet as shown in FIG. 2, number of electrodes per acre,
number of producer wells per acre,
number of ground wells per acre,
number of holes to be drilled per acre,
maximum electrode power in megawatts,
approximate voltage,
maximum temperature at producer wells in deg. C,
maximum temperature at electrode in deg. C.

TABLE 2

OIL SHALE RF HEATING FORECASTS

| | Triplate device | Present Invention | Triplate device | Present Invention | TC 7-SPOT |
|---|---|---|---|---|---|
| L (ft.) | 124.50 | 124.50 | 141.48 | 141.48 | — |
| M (ft.) | 79.23 | 79.23 | 79.23 | 79.23 | — |
| No. of electrodes per acre | 2.21 | 4.42 | 1.94 | 3.89 | 11.08 |
| No. of producer wells per acre | 2.21 | 4.42 | 1.94 | 3.89 | 5.54 |
| No. of ground wells per acre | 2.21 | 0.00 | 1.94 | 0.00 | — |
| No. of wells drilled per acre | 6.62 | 8.83 | 5.83 | 7.77 | 16.62 |
| Max electrode power (megawatts) | 1.00 | 0.50 | 1.20 | 0.60 | 0.16 |
| Apprx. voltage (volt) relative to ground | 5000 | ±2500 | +6000 | ±3000 | +480 |
| Max T at producer wells (°C.) | 460.00 | 350.00 | 450.00 | 300.00 | — |
| Max T at electrodes (°C.) | | 600 | | 600 | 800 |

The triplate device has been modified to include coaxial RF lines as in the present invention for the values of Table 2. The advantages of the present invention inherent in Table 2 are:

1) the voltage relative to ground for the balanced-line is half that of the triplate device, leading to a safer installation;
2) the required power per well for the triplate device is twice that of the balanced-line RF array;
3) the maximum temperature at the production wells is significantly hotter for the triplate device (460° C. vs. 350° C.), leading to thermal cracking of liquid hydrocarbons;
4) there can be RF leakage outside the triplate device to distant grounds, as well as significant current return to the grounded outer conductor of the coaxial line. This leakage will not occur with the balanced-line RF array; and
5) there are 8.83 holes to be drilled per acre in the RF pattern compared with 16.62 in the TC pattern.

While several presently preferred embodiments of the novel system have been described in detail herein, many modifications and variations will now become apparent to those skilled in the art. It is, therefore, to be understood that the appended claims are intended to cover all such modifications and variations as fall within the true spirit of the invention.

What is claimed is:

1. A system for extracting oil in-situ from a hydrocarbon bearing layer below a surface layer comprising:

a) a master oscillator for producing a fundamental frequency;

b) a plurality of heating sources, each comprising:

radiofrequency (RF) producing means for providing a radiofrequency excitation signal based upon the fundamental frequency, a coaxial line coupled to the RF producing means for passing the radiofrequency signal through said surface layer without substantial loss of power;

a conductive electrode located in the hydrocarbon bearing layer having a length related to the radiofrequency signal and adapted for radiating energy into said hydrocarbon bearing layer for causing shade oil to be extracted;

a plurality of matching elements, each matching element coupled, respectively, between each respective electrode and a respective coaxial line for maximizing radiation emitted by the electrodes when they receive the radiofrequency signal; and c) a plurality of producer wells adapted for collecting the extracted shale oil.

2. The system for extracting oil as recited in claim 1 wherein the electrode has a length being an odd multiple of quarter wavelengths of a fundamental wavelength of the radiofrequency excitation signal.

3. The system for extracting oil as recited in claim 1 wherein the electrodes have a length d defined by:

$$d=(2n+1)(\lambda/4)$$

where n is any positive whole integer, and λ is a fundamental wavelength of the radiofrequency excitation signal.

4. The system for extracting oil as recited in claim 1 wherein the electrodes are arranged in rows being close to each other as compared to the radiofrequency excitation fundamental wavelength λ, with the electrodes of each row having the same polarity of excitation, and alternate rows having opposite polarities so as to cause excitation of adjacent rows to be 180° out of phase, thus forming a "balanced line" configuration.

5. The system for extracting oil as recited in claim 1 wherein the RF producing means comprises an RF amplifier.

6. A method of extracting oil from a hydrocarbon bearing layer beneath a surface layer comprising the steps of:

a) drilling a plurality of rows of holes through said surface layer and into said hydrocarbon bearing layer;

b) inserting electrodes coupled to shielded coaxial cables into the holes such that the electrodes extend into said hydrocarbon bearing layer and the coaxial cables extend above said surface layer;

c) passing a radiofrequency (RF) excitation signal through the coaxial cables such that RF radiation is transmitted from the electrodes into said hydrocarbon bearing layer to cause oil to be extracted from said hydrocarbon bearing layer, the RF excitation signal for each electrode in alternative rows having the same phase, and the RF excitation signal for electrodes in a row having a phase 180° different from an adjacent row; and d) collecting the oil which is extracted.

7. The method of extracting oil as recited in claim 6 wherein the step of collecting the oil comprises forcing the extracted oil through the drilled holes, acting as production wells.

* * * * *